US009494052B2

(12) United States Patent
Feindel et al.

(10) Patent No.: US 9,494,052 B2
(45) Date of Patent: Nov. 15, 2016

(54) DUAL-INTENT LOCATOR PIN AND REMOVABLE PLUG FOR GAS TURBINES

(75) Inventors: David T. Feindel, Ellington, CT (US); Jorge I. Farah, Harford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 720 days.

(21) Appl. No.: 13/431,041

(22) Filed: Mar. 27, 2012

(65) Prior Publication Data

US 2013/0259646 A1 Oct. 3, 2013

(51) Int. Cl.
*F01D 25/24* (2006.01)
*F01D 21/00* (2006.01)

(52) U.S. Cl.
CPC ..... *F01D 25/246* (2013.01); *F01D 21/003* (2013.01); *F05D 2260/403* (2013.01); *F05D 2260/80* (2013.01); *Y10T 29/49229* (2015.01)

(58) Field of Classification Search
CPC ..... F01D 21/003; F01D 25/246; Y10T 29/49229; F05D 2260/80
USPC ..... 415/118, 201; 60/801, 803; 365/241.1, 365/241.2, 241.3, 241.4, 241.5, 241.6; 29/889.2, 889.21, 889.22
See application file for complete search history.

(56) References Cited

U.S. PATENT DOCUMENTS

| | | | | |
|---|---|---|---|---|
| 4,406,580 | A * | 9/1983 | Baran, Jr. | 415/118 |
| 5,115,636 | A * | 5/1992 | Zeiser | 60/803 |
| 5,152,662 | A * | 10/1992 | Hirst | F01D 21/003 415/118 |
| 5,431,534 | A * | 7/1995 | Charbonnel | 415/118 |
| 5,867,976 | A * | 2/1999 | Ziegler, Jr. | 60/803 |
| 6,468,033 | B1 | 10/2002 | Weidlich | |
| 7,458,768 | B2 * | 12/2008 | Dube et al. | 415/115 |
| 2010/0166537 | A1 * | 7/2010 | Walker | F01D 25/24 415/118 |
| 2010/0275574 | A1 * | 11/2010 | Salunkhe | 60/39.091 |

FOREIGN PATENT DOCUMENTS

FR 2708072 A1 1/1995

OTHER PUBLICATIONS

Supplementary European Search Report; Application No. 13769681.1-1310/2331378; Mailing Date Nov. 17, 2015; 8 pages.

* cited by examiner

*Primary Examiner* — Richard Edgar
*Assistant Examiner* — Jesse Prager
(74) *Attorney, Agent, or Firm* — Cantor Colburn LLP

(57) ABSTRACT

A borescope plug configuration is disclosed. The borescope plug configuration comprises an inspection path defined through a bore in a first engine structure, a second engine structure, and an opening into the gas path of an engine. The borescope plug configuration further comprises a removable plug for sealing the inspection path. The removable plug is adapted to couple the first engine structure to the second engine structure.

10 Claims, 5 Drawing Sheets

DUAL-INTENT LOCATOR PIN AND REMOVABLE PLUG FOR GAS TURBINES

TECHNICAL FIELD

The present disclosure relates generally to gas turbine engines and, more particularly, to a borescope plug configuration for gas turbines.

BACKGROUND

Gas turbine engines often have multiple casings, such as an inner and outer wall spaced apart from each other. These spaced apart walls typically include opposing openings to allow for access of inspection devices into the gas path and inner components of the engine. Common inspection devices include borescopes, proximity probes, or laser probes. Known borescope plugs are used to seal the opposing openings in the casings of the gas turbine engine. However, due to the very high temperatures at which gas turbine engines operate, the engine casings undergo thermal growth and expansion. As a result, leakage may still occur when a borescope plug cannot accommodate for these thermal transitions.

Historically, borescope plugs have been non-structural, removable plugs that fill the access hole from the outer case into the gas-path to minimize leakage. Typical borescope plugs can be either solid or flexible. Solid borescope plugs fill the leakage hole but are limited in movement and must be located near the center of thermal growth locations to minimize deflection. Flexible borescope plugs generally have a spring or a thin section to allow radial or axial movement to account for thermal growth. However, many problems persist with the prior art borescope plugs, such as cracking, bending, buckling, installation and withdrawal difficulties.

Thus, there exists a need for a simplified, more reliable borescope plug configuration. This disclosure is directed to solving this need and provides a way to reduce the cost and complexity of a borescope plug assembly.

SUMMARY OF THE INVENTION

According to one embodiment of the present disclosure, a borescope plug configuration is disclosed. The borescope plug configuration may comprise an inspection path defined through a bore in a first engine structure, a second engine structure, and an opening into the gas path of an engine. The borescope plug configuration may further comprise a removable plug for sealing the inspection path. The removable plug may be adapted to couple the first engine structure to the second engine structure.

According to another embodiment, a gas turbine engine is disclosed. The gas turbine engine may comprise a plurality of bores through a first gas turbine engine structure, a plurality of pins, an inspection path, and a removable plug for insertion into the inspection path. The plurality of bores may be equally spaced around a circumference of a gas turbine engine. The plurality of pins may be adapted for insertion into the bores to couple the first gas turbine engine structure to a second gas turbine engine structure. The inspection path may be defined through one of the bores, the second gas turbine engine structure, and an opening into a gas path of the gas turbine engine. The removable plug may also be adapted to couple the first gas turbine engine structure to the second gas turbine engine structure.

According to yet another embodiment, a method for constructing a borescope plug assembly within a gas turbine engine is disclosed. The method may comprise providing a gas turbine engine with a plurality of bores through a first gas turbine engine structure, the bores equally spaced around a circumference of a gas turbine engine, and a plurality of pins adapted for insertion into the bores to couple the first gas turbine engine structure to a second gas turbine engine structure. The method may further comprise defining an inspection path through at least one of the bores, the second gas turbine engine structure, and an opening into a gas path of the gas turbine engine. The method may further comprise inserting a removable plug into the inspection path, with the removable plug adapted to couple the first gas turbine engine structure to the second gas turbine engine structure.

These and other aspects and features of the disclosure will become more readily apparent upon reading the following detailed description when taken in conjunction with the accompanying drawings.

DETAILED DESCRIPTION

While the following detailed description has been given and will be provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed with the claims appended hereto.

Figure 1:
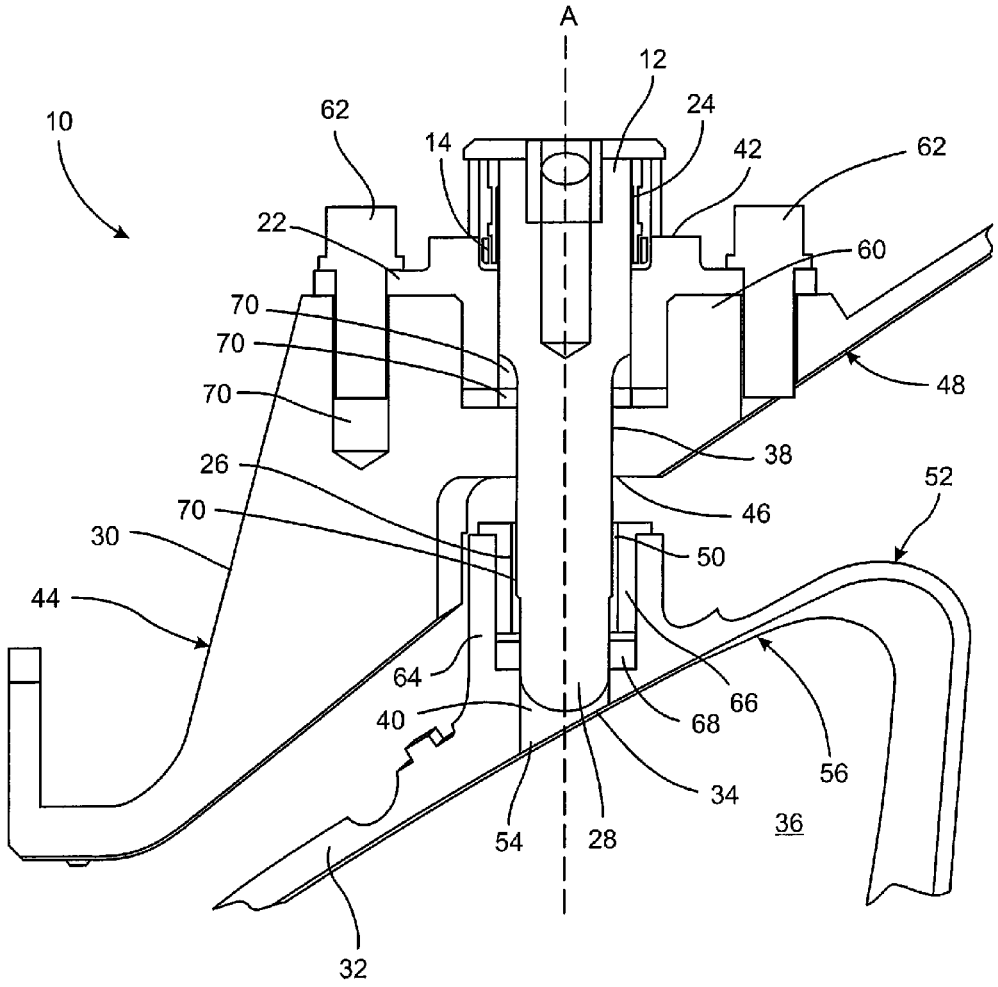
FIG. 1 is a cross-sectional view of a borescope plug configuration made according to one embodiment of the present disclosure.
Figure 2:
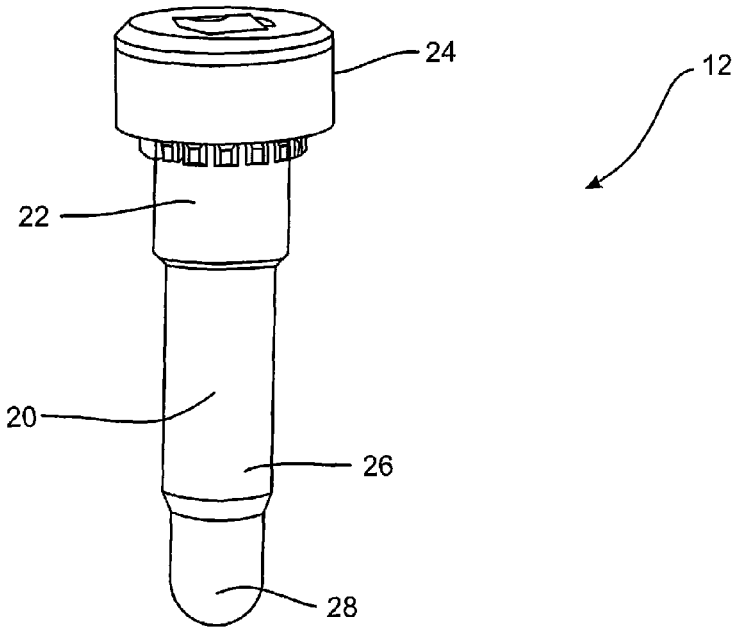
FIG. 2 is a perspective view of the borescope plug of FIG. 1.
Figure 3:
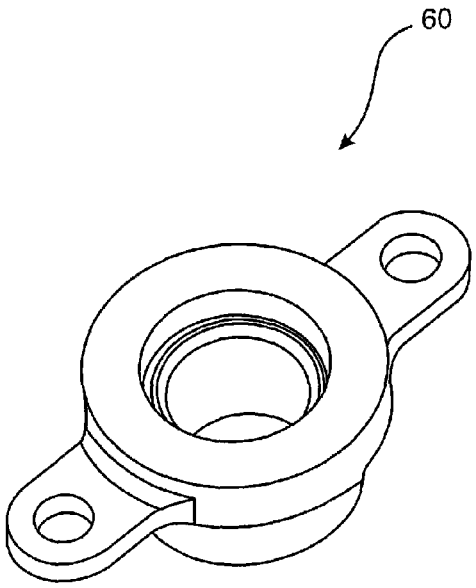
FIG. 3 is a perspective view of the sleeve assembly of FIG. 1.
Figure 4:
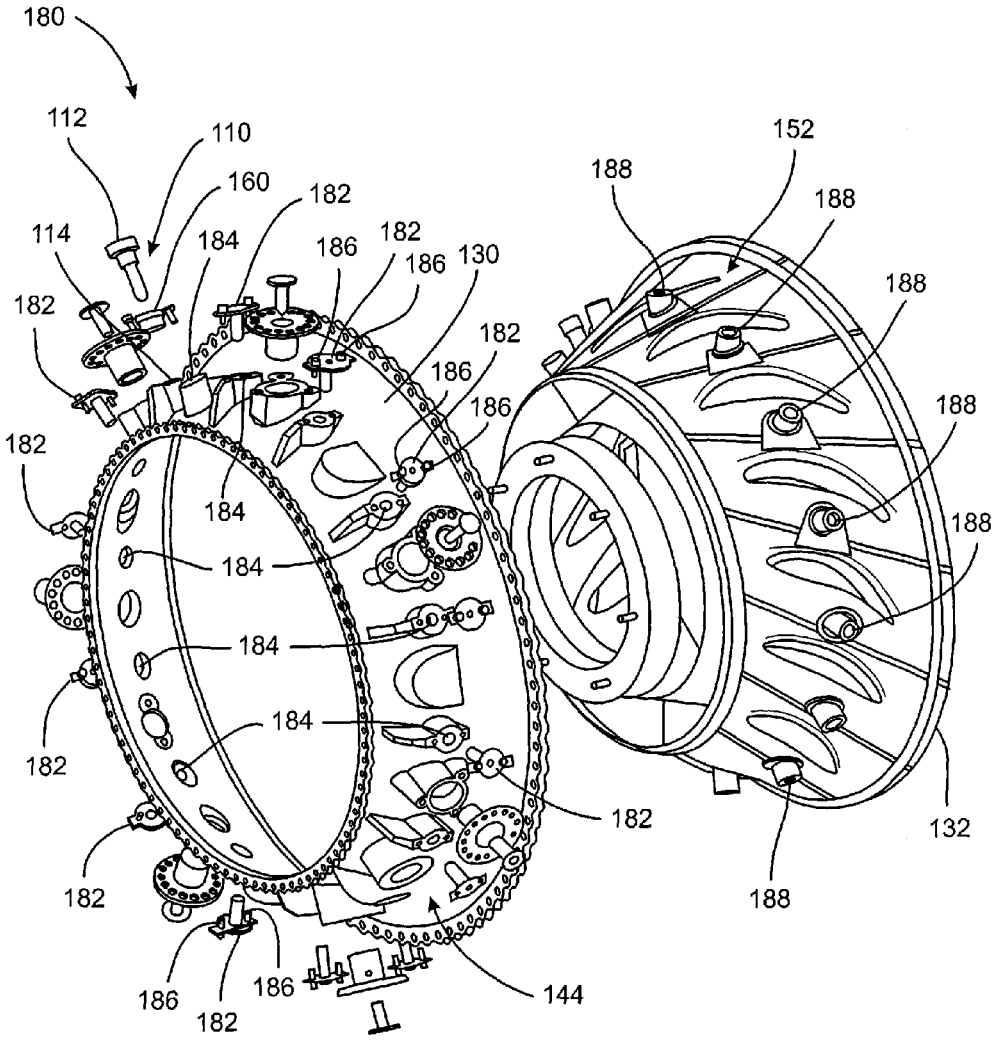
FIG. 4 is an exploded perspective view of a borescope plug configuration incorporated into a locator pin assembly according to another embodiment of the present disclosure.
Figure 5:
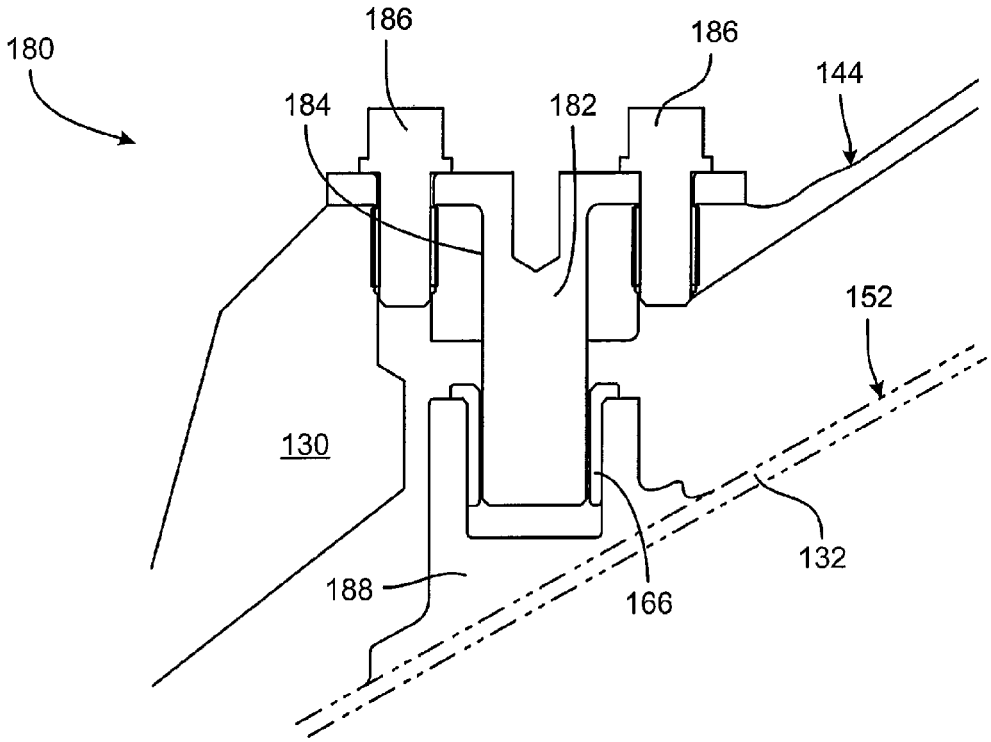
FIG. 5 is a cross-sectional view of the locator pin assembly of FIG. 4.
Figure 6:
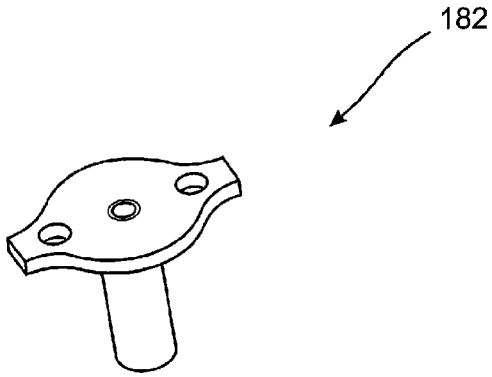
FIG. 6 is a perspective view of the pin of FIG. 4.
Figure 7:
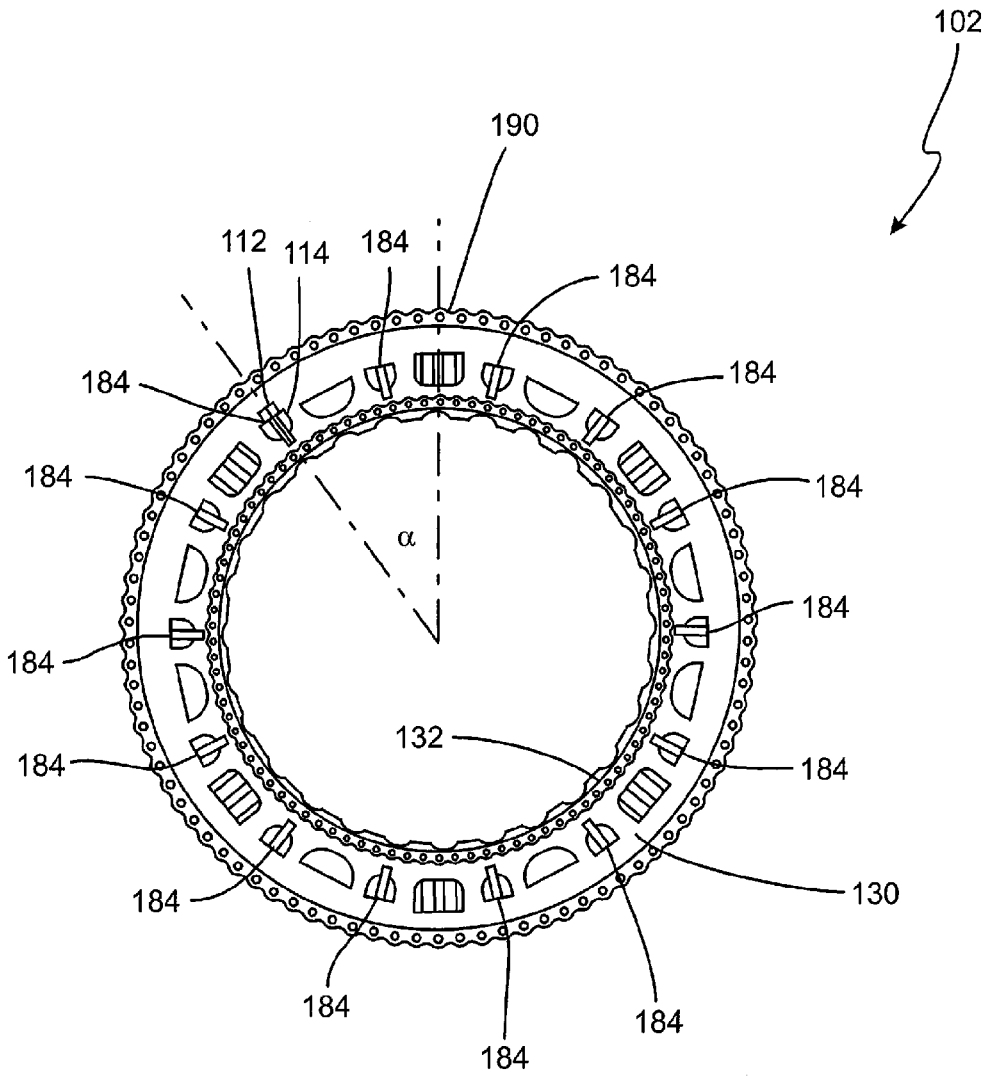
FIG. 7 is a perspective view of the front of a gas turbine engine looking aft according to an embodiment of the present disclosure.

Referring to FIGS. 1-3, a borescope plug configuration 10 for a gas turbine engine is shown according to one embodiment of the present disclosure. The borescope plug configuration 10 may comprise a removable plug 12 and an inspection path 14. As shown best in FIG. 2, the removable plug 12 may comprise a shaft 20 having an upper end portion 22, a cap 24, a lower end portion 26, and a spherical tip 28. Referring now to FIG. 1, the removable plug 12 may seal and fill the inspection path 14 during operation of the gas turbine engine to avoid gas leakage. The inspection path 14 may comprise a bore through the outer case 30 and the vane pack 32 of the gas turbine engine. The inspection path 14 may extend through an opening 34 into the gas path 36. In this way, the inspection path 14 allows access by a borescope, or other inspection device, for inspection and monitoring of the inner cavities of the gas turbine engine during on-wing inspections.

More specifically, the inspection path 14 may have a first bore 38 through the outer case 30 and a second bore 40 through the vane pack 32. The first bore 38 may extend from a first opening 42 on the outer surface 44 of the outer case 30 to a second opening 46 on the inner surface 48 of the outer case 30. The second bore 40 may extend from a first opening 50 on the outer surface 52 of the vane pack 32 to a second opening 54 on the inner surface 56 of the vane pack 32. The first and second bores 38, 40 may be aligned along the same axis A to receive the removable plug 12, borescope, or other inspection device. Although shown and described as comprising bores 38, 40 through an outer case 30 and vane pack 32 of a gas turbine engine, it will be understood that the inspection path 14 may comprise a bore through any engine structure or structures to permit access of a borescope, or any other on-wing inspection device.

The outer case 30 may be adapted to receive the removable plug 12 via a sleeve assembly 60 mounted by bolts 62 to the outer surface 44 of the outer case 30. Extending through the first bore 38, the sleeve assembly 60 may receive the upper end portion 22 of the removable plug 12. The sleeve assembly 60 may engage the removable plug 12 and fasten the cap 24 of the removable plug 12 such that the plug 12 is fixed within the outer case 30 during engine operation. During on-wing inspections, the plug 12 may be repeatedly removed and reinstalled into the sleeve assembly 60 of the outer case 30 of the gas turbine engine. Although shown and described as attaching the removable plug 12 to the outer case 30 through mating engagement with the sleeve assembly 60, it will be understood that any means of attachment between the removable plug 12 and the outer case 30 may be used without departing from the scope of this disclosure.

The vane pack 32 may include a boss 64 adapted to receive the removable plug 12 through the vane pack 32. The boss 64 may comprise the second bore 40, a bushing 66, and a washer seal 68. Disposed within the boss 64, the bushing 66 may receive the lower end portion 26 of the removable plug 12 and the washer seal 68 may receive the spherical tip 28 of the plug 12. As the cap 24 of the plug 12 is fastened to the sleeve assembly 60 of the outer case 30, the upper end portion 22 is received in the outer case 30, and the lower end portion 26 is received in the boss 64 of the vane pack 32, the removable plug 12 couples the outer case 30 and the vane pack 32 together. Thus, in addition to sealing the inspection path 14 during engine operation, the removable plug 12 also locates the vane pack 32 within the outer case 30 and transfers the load between the two components. In this way, the borescope plug configuration 10 of the present disclosure provides both sealable access to inspection of the gas path 36 and structural load-bearing functionality at the same time.

To compensate for thermal transitions between the removable plug 12 and the vane pack 32, the removable plug 12 is allowed to slide radially in the bushing 66. The material of the bushing 66 and the material of the removable plug 12 may comprise a wear couple to limit the erosion wear between the bushing 66 and removable plug 12 during thermal transitions. For exemplary purposes only, the bushing 66 may be made of, including but not limited to, a cobalt-based alloy while the removable plug 12 may be made of, including but not limited to, a nickel-based alloy. This wear couple results in good wear and erosion resistance between the bushing 66 and the plug 12, although other materials are certainly possible. Furthermore, there may be gaps 70 between the plug 12, the sleeve assembly 60, the outer case 30, and the bushing 66 to allow for thermal expansion during engine operation.

According to another embodiment of the present disclosure shown in FIGS. 4-7, the borescope plug configuration 110 may be incorporated into a locator pin assembly 180. The locator pin assembly 180 locates the entire vane pack 132 within the outer case 130. The locator pin assembly 180 may comprise a plurality of pins 182 and a plurality of equally spaced bores 184 around the circumference of the outer case 130. Each of the pins 182 may be mounted by bolts 186 to the outer surface 144 of the outer case 130 and may extend through the bores 184 of the outer case 130. The vane pack 132 may include a plurality of equally spaced bosses 188 around the circumference of the vane pack 132. The plurality of bosses 188 on the vane pack 132 correspond to and are aligned with the plurality of bores 184 on the outer case 130. Mounted to the outer surface 152 of the vane pack 132, each of the bosses 188 on the vane pack 132 may be adapted to receive a pin 182 and may include a bushing 166. As the plurality of pins 182 are bolted to the outer case 130 and are received by the bosses 188 of the vane pack 132, the pins 182 couple the outer case 130 and the vane pack 132 together. The pins 182 locate the vane pack 132 within the outer case 130 and transfer the load between the two components.

The inspection path 114 and sleeve assembly 160 of the borescope plug configuration 110 may comprise at least one of the bores 184 of the locator pin assembly 180 and may extend through the outer case 130, vane pack 132, and an opening into the gas path (not shown). As shown best in FIG. 7, the inspection path 114 may be positioned in a bore 184 of the locator pin assembly 180 between a thirty degree (30°) and one hundred twenty degree (120°) angle relative to the top 190 of the gas turbine engine 102, although other positions are certainly possible. For exemplary purposes only, the inspection path 114 may be positioned at a 38.571° angle $\alpha$ from the top 190 of the gas turbine engine 102.

The removable plug 112 may take the place of at least one of the pins 182 and may be used to fill the inspection path 114. Similar to the pins 182 of the locator pin assembly 180, the removable plug 112 may be used to locate the vane pack 132 within the outer case 130 and handle the same load between the components. The material of the removable plug 112 may match the material of the pins 182. For example, the plug 112 and pins 182 may both be made of, including but not limited to, a nickel-based alloy. Other materials for the plug 112 and pins 182 are certainly possible. By matching the material and tolerance of the pins 182, the removable plug 112 has the same wear characteristics and common load interaction, thereby lengthening the life cycle of the plug 112 to that of the pins 182.

From the foregoing, it can be seen that the present disclosure sets forth an improved borescope plug configuration which can be used to dually enable borescope access and locate the vane pack within the outer case. While installed, the borescope plug of the present disclosure is a structural member of the load path but is also removable for borescope inspection of the inner cavities of a gas turbine engine for on-wing inspections. As part of the locator pin assembly, the borescope plug does not require axial or radial compliance. Moreover, by taking the place of one of the locator pins, the removable plug reduces the engine part count required for a separate borescope plug and separate borescope engine access. By providing a robust borescope architecture and structural capability, the borescope plug configuration of the present disclosure resolves the design problems of the prior art borescope plugs and compensates for thermal transitions, all in a simplified, reliable and cost-effective manner.

What is claimed is:

1. A gas turbine engine comprising:

a plurality of bores through a first gas turbine engine structure, the bores equally spaced around a circumference of a gas turbine engine;

a plurality of pins adapted for insertion into the bores to couple the first gas turbine engine structure to a second gas turbine engine structure;

an inspection path defined through one of the bores, the second gas turbine engine structure, and an opening into a gas path of the gas turbine engine; and a removable plug for insertion into the inspection path, the removable plug adapted to couple the first gas turbine engine structure to the second gas turbine engine structure, the second gas turbine engine structure including a plurality of bushings adapted to allow radial movement of the pins and the removable plug, the plurality of bushings configured to reduce erosion wear with the pins and the removable plug during thermal transitions.

2. The gas turbine engine of claim 1, wherein the plurality of pins and the removable plug are further adapted to locate the second engine structure within the first engine structure.

3. The gas turbine engine of claim 1, wherein the plurality of pins and the removable plug are further adapted to transfer the load between the first engine structure and the second engine structure.

4. The gas turbine engine of claim 1, wherein the first gas turbine engine structure is an outer case.

5. The gas turbine engine of claim 4, wherein the second gas turbine engine structure is a vane pack.

6. The gas turbine engine of claim 5, wherein the vane pack includes a plurality of bosses adapted to receive the pins and the removable plug.

7. A method for constructing a borescope plug assembly within a gas turbine engine comprising:

providing a gas turbine engine with a plurality of bores through a first gas turbine engine structure, the bores equally spaced around a circumference of a gas turbine engine, and a plurality of pins adapted for insertion into the bores to couple the first gas turbine engine structure to a second gas turbine engine structure;

defining an inspection path through at least one of the bores, the second gas turbine engine structure, and an opening into a gas path of the gas turbine engine; and inserting a removable plug into the inspection path, the removable plug adapted to couple the first gas turbine engine structure to the second gas turbine engine structure, the second gas turbine engine structure including a plurality of bushings adapted to allow radial movement of the pins and the removable plug, the plurality of bushings configured to reduce erosion wear with the pins and the removable plug during thermal transitions.

8. The method according to claim 7, wherein the first gas turbine engine structure is an outer case.

9. The method according to claim 8, wherein the second gas turbine engine structure is a vane pack.

10. The method according to claim 9, wherein the vane pack includes a plurality of bosses adapted to receive the pins and the removable plug.

* * * * *